US011313639B2

(12) United States Patent
Boone et al.

(10) Patent No.: US 11,313,639 B2
(45) Date of Patent: Apr. 26, 2022

(54) AUTO-LOADING HAMMER-TYPE FIREARM WITH SELECTABLE LIVE FIRE AND TRAINING MODES

(71) Applicant: Mustang Industrial Design, Inc., Plano, TX (US)

(72) Inventors: Raymond Boone, Plano, TX (US); Joel Muskovich, Rowlett, TX (US); Michael Abraham, Plano, TX (US); Brian Bascom, Plano, TX (US)

(73) Assignee: Mustang Industrial Design, Inc., Plano, TX (US)

( * ) Notice: Subject to any disclaimer, the term of this patent is extended or adjusted under 35 U.S.C. 154(b) by 0 days.

(21) Appl. No.: 16/630,463

(22) PCT Filed: Jul. 14, 2017

(86) PCT No.: PCT/US2017/042026
§ 371 (c)(1),
(2) Date: Jan. 12, 2020

(87) PCT Pub. No.: WO2019/013806
PCT Pub. Date: Jan. 17, 2019

(65) Prior Publication Data

US 2021/0148667 A1 May 20, 2021

(51) Int. Cl.
*F41A 33/06* (2006.01)
*F41A 17/74* (2006.01)
(Continued)

(52) U.S. Cl.
CPC ..... *F41A 33/06* (2013.01); *F41A 17/74* (2013.01); *F41A 19/14* (2013.01); *F41A 17/36* (2013.01); *F41A 19/10* (2013.01); *F41A 19/12* (2013.01)

(58) Field of Classification Search
CPC ..... F41A 17/34; F41A 17/36; F41A 17/74; F41A 19/14; F41A 33/06; F41A 19/10; F41A 19/12
See application file for complete search history.

(56) References Cited

U.S. PATENT DOCUMENTS 2,405,308 A 8/1946 Jack
4,449,312 A 5/1984 Ruger
(Continued)

FOREIGN PATENT DOCUMENTS

CN 202814217 3/2013
EP 0268276 A2 5/1988
(Continued)

OTHER PUBLICATIONS

PCT/US2017/042026, International Search Report and Written Opinion, dated Jan. 26, 2018, 11 pages.

*Primary Examiner* — Joshua T Semick
(74) *Attorney, Agent, or Firm* — Peter V. Schroeder; Booth Albanesi Schroeder PLLC

(57) ABSTRACT

An auto-loading firearm having a system for switching between live fire and training modes via a selector switch mounted either on the firearm or on a specially designed training attachment. An action arm is selectively movable in response to movement of the selector switch between a live fire position, in which the firearm is free to operate as normal, and a training mode position where the action arm interrupts operation of the hammer and prevents the firearm from discharging while allowing the trigger and, if present, trigger spring to continue operating.

24 Claims, 9 Drawing Sheets

(51) Int. Cl.

| | |
|---|---|
| ***F41A 19/14*** | (2006.01) |
| ***F41A 17/36*** | (2006.01) |
| ***F41A 19/10*** | (2006.01) |
| ***F41A 19/12*** | (2006.01) |

(56) References Cited

U.S. PATENT DOCUMENTS

| | | | | |
|---|---|---|---|---|
| 4,845,870 | A | 7/1989 | Vernon | |
| 5,225,612 | A | 7/1993 | Bernkrant | |
| 5,320,023 | A | 6/1994 | Erdem | |
| 5,608,982 | A | 3/1997 | Bouvard | |
| 6,125,735 | A * | 10/2000 | Guhring | F41A 19/02 42/69.03 |
| 6,412,207 | B1 | 7/2002 | Crye et al. | |
| 6,457,271 | B1 | 10/2002 | Vaid et al. | |
| 6,519,887 | B1 | 2/2003 | Allen et al. | |
| 6,952,895 | B1 | 10/2005 | Zonshine | |
| 6,968,770 | B2 | 11/2005 | Barfield et al. | |
| 7,033,175 | B2 * | 4/2006 | Kunimoto | F41A 33/02 434/18 |
| 8,176,833 | B2 | 5/2012 | Quis | |
| 8,434,254 | B1 | 5/2013 | Watchorn et al. | |
| 8,495,832 | B2 | 7/2013 | Vukovic | |
| 8,585,407 | B2 * | 11/2013 | Hu | F41B 11/642 434/18 |
| 8,646,201 | B2 * | 2/2014 | Hughes | F41A 33/02 42/114 |
| 8,667,881 | B1 * | 3/2014 | Hawbaker | F41A 19/46 89/139 |
| 8,726,555 | B2 | 5/2014 | Carr | |
| 8,899,985 | B2 | 12/2014 | Walls | |
| 8,935,872 | B2 | 1/2015 | Zukowski | |
| 8,991,090 | B2 | 3/2015 | Mizrachi | |
| 9,046,313 | B1 * | 6/2015 | Lutton | F41A 19/44 |
| 9,057,577 | B2 * | 6/2015 | Hannan | F41A 19/01 |
| 9,347,725 | B2 * | 5/2016 | McAlister | F41A 19/10 |
| 9,551,546 | B2 * | 1/2017 | Alicea, Jr. | F41A 19/14 |
| 9,952,013 | B2 * | 4/2018 | Fellows | F41A 19/46 |
| 10,415,912 | B2 * | 9/2019 | Iwasawa | F41B 11/56 |
| 10,436,540 | B2 * | 10/2019 | Bascom | F41A 33/06 |
| 10,488,136 | B2 * | 11/2019 | Sullivan | F41A 17/16 |
| 2011/0005115 | A1 | 1/2011 | Cahill | |
| 2011/0306020 | A1 | 12/2011 | Peterson | |
| 2013/0316308 | A1 | 3/2013 | Monti | |
| 2014/0173964 | A1 | 6/2014 | Mizrachi | |
| 2014/0322673 | A1 | 10/2014 | Uhr | |
| 2015/0068090 | A1 * | 3/2015 | Christensen | F41A 17/82 42/69.01 |
| 2015/0226516 | A1 | 8/2015 | Dvorak | |
| 2015/0241156 | A1 | 8/2015 | Alicea | |
| 2015/0338181 | A1 | 11/2015 | McAlister | |
| 2016/0018176 | A1 * | 1/2016 | Fellows | F41A 19/14 42/69.03 |

FOREIGN PATENT DOCUMENTS

| | | | |
|---|---|---|---|
| JP | 2012215373 | A | 11/2012 |
| KR | 20070010263 | | 1/2007 |
| SU | 1762101 | A1 | 9/1992 |
| WO | 2015057360 | A1 | 4/2015 |
| WO | 2017123223 | A1 | 7/2017 |

* cited by examiner

AUTO-LOADING HAMMER-TYPE FIREARM WITH SELECTABLE LIVE FIRE AND TRAINING MODES

TECHNICAL FIELD

The present disclosure relates to generally to firearms, and more specifically to auto-loading firearms, including fully automatic and semiautomatic firearms. The disclosure presents apparatus and methods for auto-loading firearms having a live fire mode and a non-live fire, training mode.

BRIEF DESCRIPTION OF THE DRAWING

For a more complete understanding of the features and advantages of the present disclosure, reference is now made to the detailed description of the disclosure along with the accompanying figures in which corresponding numerals in the different figures refer to corresponding parts and in which.

DETAILED DESCRIPTION OF EMBODIMENTS OF THE DISCLOSURE

Figure 1:
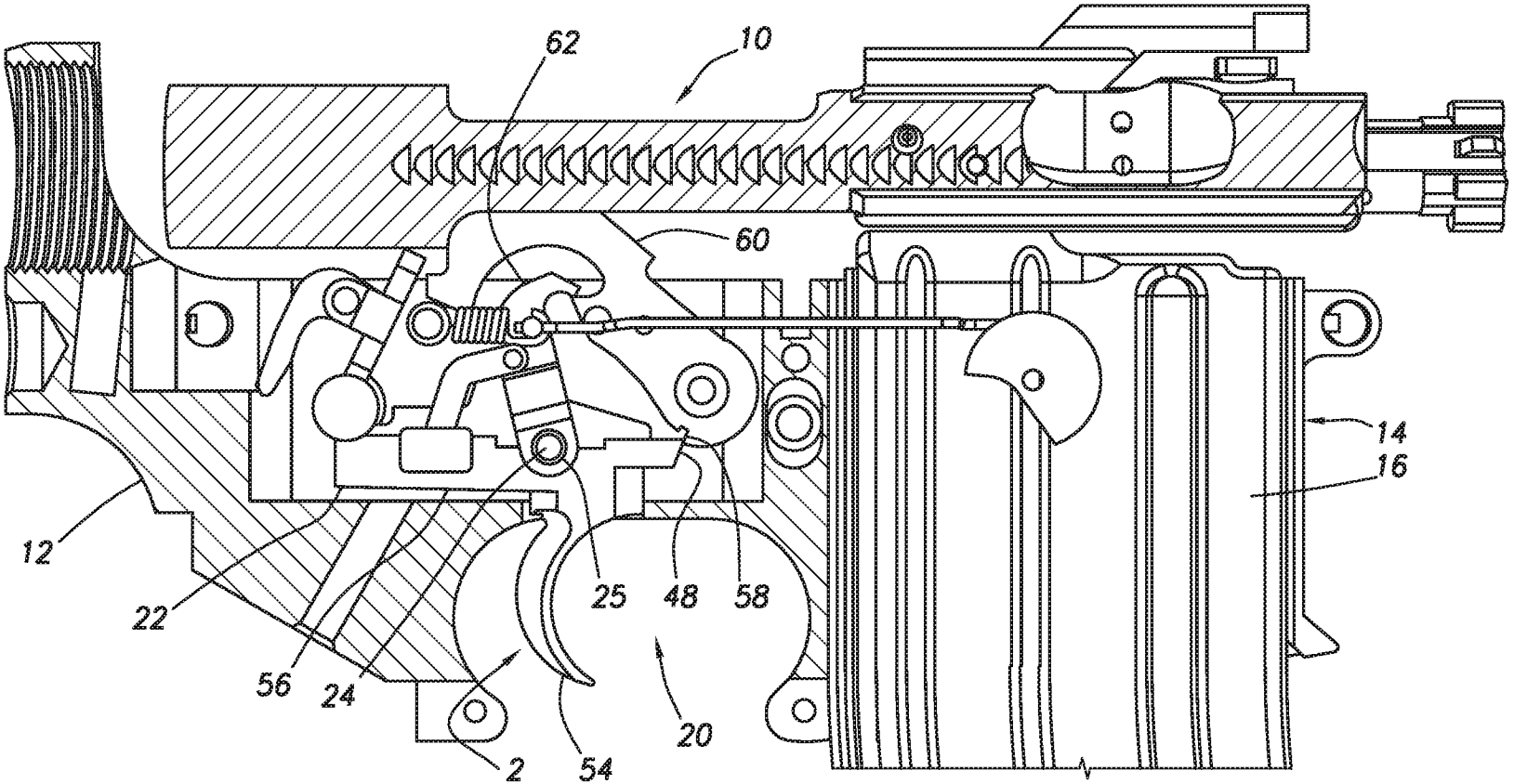
FIG. 1 is a side elevational, sectional and partial view of an exemplary auto-loading firearm in live fire mode, with the trigger in a home (not depressed) position and the hammer in a cocked position, the firearm having a training system according to an aspect of the disclosure.

The present disclosures are described by reference to drawings showing one or more examples of how the disclosures can be made and used. In these drawings, reference characters are used throughout the several views to indicate like or corresponding parts. In the description which follows, like or corresponding parts are marked throughout the specification and drawings with the same reference numerals, respectively. Drawings may not be to scale.

The disclosed apparatus and methods relate specifically to auto-loading firearms, including fully automatic and semi-automatic firearms. These firearms typically include: a frame and/or receiver assemblies, a barrel assembly, a magazine (either fixed or removable), and a trigger assembly. Some trigger assemblies include a trigger, a trigger bar, and a sear that either releases a hammer that strikes a firing pin or releases a biased striker with the firing pin striking a chambered cartridge to discharge the firearm. For further disclosure regarding use of live fire and non-live fire training modes with trigger assemblies utilizing trigger bars, see International Patent Application PCT/US2016/013294 which is incorporated herein for all purposes.

The firearms addressed specifically herein utilize trigger assemblies having a trigger, a sear (defined on the trigger or as a separate component) and a hammer as the major components. Such trigger assemblies are seen in AK and AR platforms, most modern battle rifles, and additionally in some sub-machine guns.

The term "auto-loading firearm" and similar refers only to self-reloading, semiautomatic and fully automatic firearms. Revolvers and bolt action rifles are excluded from discussion as they have dry-fire modes indistinguishable from live-fire modes making the disclosures herein unnecessary.

Auto-loading firearm models, whether semiautomatic, fully automatic, exclusively single-action, exclusively double-action, or selectively double-action/single-action, have a single mode of operation, namely a live-fire mode. Normal operation of the firearm can be prevented by switching on a safety mechanism, such as magazine drop safeties, grip safeties, trigger safeties, and manual interrupt safeties.

Training is required for safe and effective operation of a firearm, including use of the firearm in a non-live fire mode where it is not loaded with ammunition. Presented are apparatus and methods of using a "training mode" of firearm operation which allows full functionality simulation while disabling live-fire operation.

The most common non-live fire training option is a practice called "dry fire," which develops trigger control without having to contend with recoil and report. Dry firing is a manual process requiring cocking of the firearm's hammer or striker, taking aim, and pulling the trigger to simulate firing. The process is repeated (manually cock, aim, pull trigger) to take additional practice "shots." Only a single simulated shot is "fired" with each cycle. For single-action auto-loading firearms, this training practice is not realistic, given the semi-automatic nature of the firearm, nor effective in creating muscle memory and skill. For selectively double-action/single-action firearms such training practice is also not realistic, as the longer and heavier initial trigger pull must be repeated in each instance, or the hammer or striker mechanism manually reset, to allow practice using the lighter single-action trigger pull. Additionally, there is a negative training impact in training by only performing a single shot and recycle procedure.

The disclosed apparatus and methods address limitations of current training options by providing training with an operable auto-loading firearm, having similar weight, balance and configuration as in live mode, realistic feedback in trigger pull and reset, and full functionality of the auto-loading firearm as in live fire mode except for actual firing of a round. The disclosure addresses realistic feedback recoil and sound. The training system allows seamless transition from a live-fire mode to a training mode having secondary safety features. In an embodiment, an affirmative action by the user is required to return the firearm to live-fire mode.

The firearm provides selectable firing and training modes, with selection performed by a mechanical selector movable between live fire and training positions.

In live fire mode, the present firearm's internal system is configured such that a trigger, having a sear defined thereon, rests against a notch defined on the hammer and, upon depression of the trigger, releases the cocked hammer or striker. This configuration is analogous to standard operation of an auto-loading firearm not having the training system. Rather than repeat "hammer or striker" throughout the description, use of the term "hammer" is intended to and does refer to both hammers and strikers unless the context does not otherwise permit.

In training mode, the firearm's internal system is configured such that rotational operation of the hammer is interrupted or prevented and the trigger no longer acts on the hammer. Instead, the trigger connects to a trigger-resetting system or trigger break simulator. In training mode the firearm is inoperable to release the hammer and cannot fire a round.

The firearm remains in training mode as long as a mode selector switch is kept in the training mode position. For example, in some embodiments, the firearm remains in training mode only while a specialized training device, such as a "training magazine," remains attached to the firearm.

The firearm training system reverts to live fire mode when the mode selector switch is moved to the live fire position. In some embodiments, reversion to live fire mode is performed by user-manipulation of a mechanism (e.g., switch, lever), while in others reversion occurs with detachment of the training device (e.g., removal of the training magazine). In an embodiment, the system only reverts to live fire mode after an ammunition loading mechanism is manually activated, or the trigger pressed forward after removal of the training device, to prevent accidental discharge. In other embodiments, the system reverts to live fire mode automatically upon detachment of the training device and consequent activation of the mode selector.

As used herein "training magazine" and the like are used to indicate a training device, or training attachment, which releasably attaches to the firearm via the magazine well. It is understood that the "training magazine" does not contain live or blank ammunition rounds.

Activation of the mode selector can be performed by any mechanism capable of acting as or manipulating a lever, including manual, hydraulic, electric, electromagnetic, or inertial mechanisms. In an embodiment, selection of training mode is performed by attachment of a training device designed for that purpose. Upon attachment, the training device automatically moves the mode selector to training mode; and upon detachment, the selector returns the firearm to live fire mode. The training device can also comprise a trigger-resetting mechanism used in the training mode.

The training device, in some embodiments, comprises a specialized magazine. Alternate embodiments can include external devices selectively attachable to the firearm, such as selectively mountable on Picatinny or accessory rails, in the grip panels, or as part of or comprising an external, removable handguard, etc.

Figure 2:
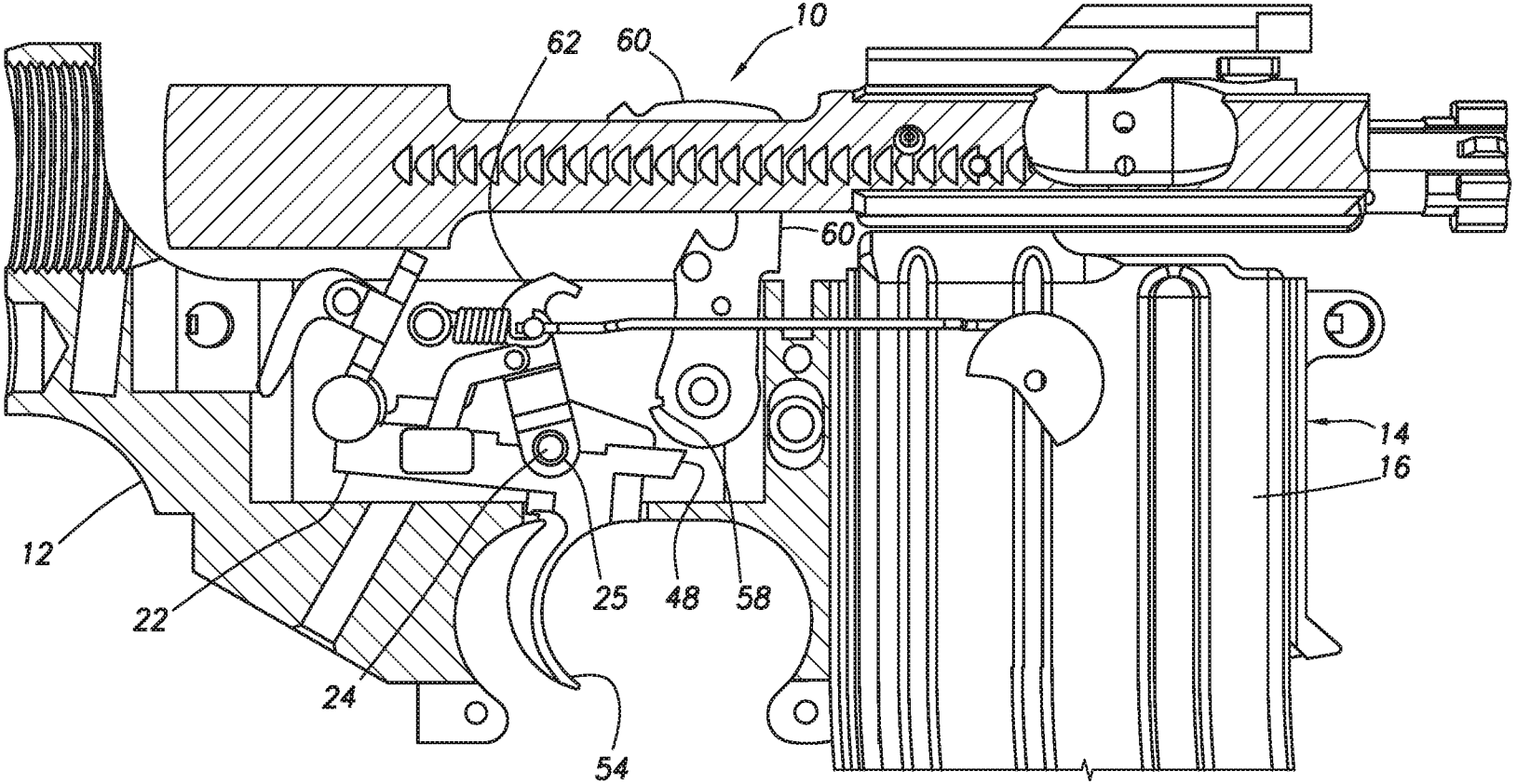
FIG. 2 is a side elevational, sectional and partial view of the exemplary auto-loading firearm of FIG. 1 in live fire mode, with the trigger depressed and the hammer in the discharge position.

FIG. 1 is a side elevational, sectional and partial view of an exemplary auto-loading firearm in live fire mode, with the trigger in a home (not depressed) position and the hammer in a cocked position, the firearm having a training system according to an aspect of the disclosure. FIG. 2 is a side elevational, sectional and partial view of the exemplary auto-loading firearm of FIG. 1 in live fire mode, with the trigger depressed and the hammer in the discharge position. The FIGS. 1-2 are discussed together.

The auto-loading firearm 10 has a frame 12 (or receiver) defining supports for the internal and external mechanisms of the firearm. For example, a grip and barrel (not shown) are part of or attached to the firearm frame 12. A magazine well 14 (a magazine well wall is obscured behind the magazine 16 in FIGS. 1-2) defines a cavity for insertion of a detachable magazine 16. Not shown are cartridges and followers positioned in the magazine for feeding rounds into the firing chamber. Note that FIGS. 1-2 do not show the magazine well front wall (nearest the viewer) as it would obscure the transfer mechanisms and other elements of the firearm. The transfer mechanism 84 appears to "float" in the view as the magazine well wall to which it is attached is not shown.

The firearm 10 includes elements of the training system, generally designated 2, as well as common operable elements found in auto-loading firearms. Typical firearm elements such as bolt assemblies, gas chambers and return assemblies, grips, barrels, stocks, firing pins, and the like are not discussed as they are common in the art and understood by practitioners of the art and their function is not effected by the training system disclosed herein. Accessory items can include scopes, silencers, lights, slings, laser sights, etc.

Attached to and partially housed by the frame 12 is a trigger assembly 20 having a trigger 22, trigger pivot 24, and optionally a trigger return spring 25 (here, a torsion spring on the pivot pin). The trigger pivot 24 is commonly a pin extending laterally through the trigger 22 and rotatably attached to the frame 12. The trigger 22 is seen in a home position (not depressed) in FIG. 1. The trigger 22 rotates about the trigger pivot 24 to a depressed position, seen at FIG. 2, when activated by the user. The trigger, trigger mount, trigger return spring, etc., can be of various types and configurations, as is known in the art. The trigger assembly seen here is exemplary and persons of skill in the art will understand modification needed for other trigger assembly types. Some auto-loading firearms do not employ a trigger return spring although it is rare.

The trigger 22 includes a finger pull 54 and a trigger body 56 defining a sear 48. The sear 48, in the live fire mode and cocked position, FIG. 1, contacts a cooperating notch 58 defined in the hammer 60. As the trigger 22 is depressed, the sear 48 slides across the notch 58 until the sear 48 disengages from the hammer 60 and the hammer 60 is free to rotate to the discharge position in FIG. 2. The hammer 60 is cocked against a biasing mechanism (not shown) which biases and moves the hammer to the discharge position upon disengagement of the sear from the hammer, thereby discharging the firearm.

In some firearm designs, the trigger interacts directly with the hammer, as here. In other designs, a firearm trigger and sear are separate components, with the trigger acting on the sear and the sear acting on the hammer in turn.

After discharge of the firearm, the auto-loading and re-cocking assemblies of the firearm automatically return the hammer 60 to a cocked position as is understood by those of skill in the art. If the trigger 22 is still depressed after discharge and auto-return rotation of the hammer 60, a disconnector (not shown) captures the hammer 60 temporarily, preventing its return to the cocked position, until the trigger is released to its home position. Once the trigger is released, the hammer returns to the cocked position with the sear of the trigger engaging the notch on the hammer. Similarly, after discharge of the firearm, the trigger 22 is returned to its home position by the trigger spring.

Figure 3:
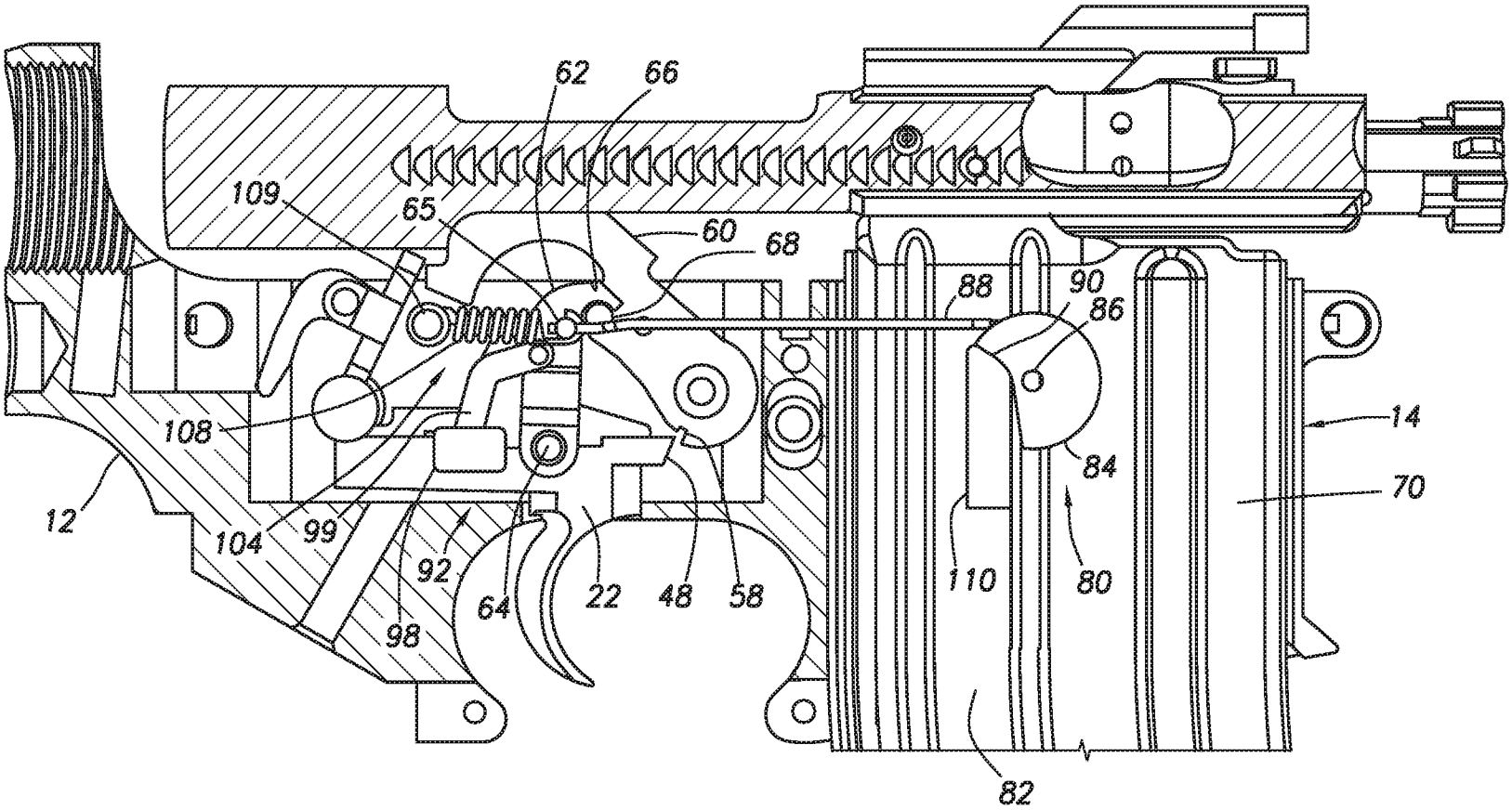
FIG. 3 is a side elevational, sectional and partial view of an exemplary auto-loading firearm in training mode, with the trigger in a home (not depressed) position and the hammer in a cocked and interrupted position.
Figure 4:
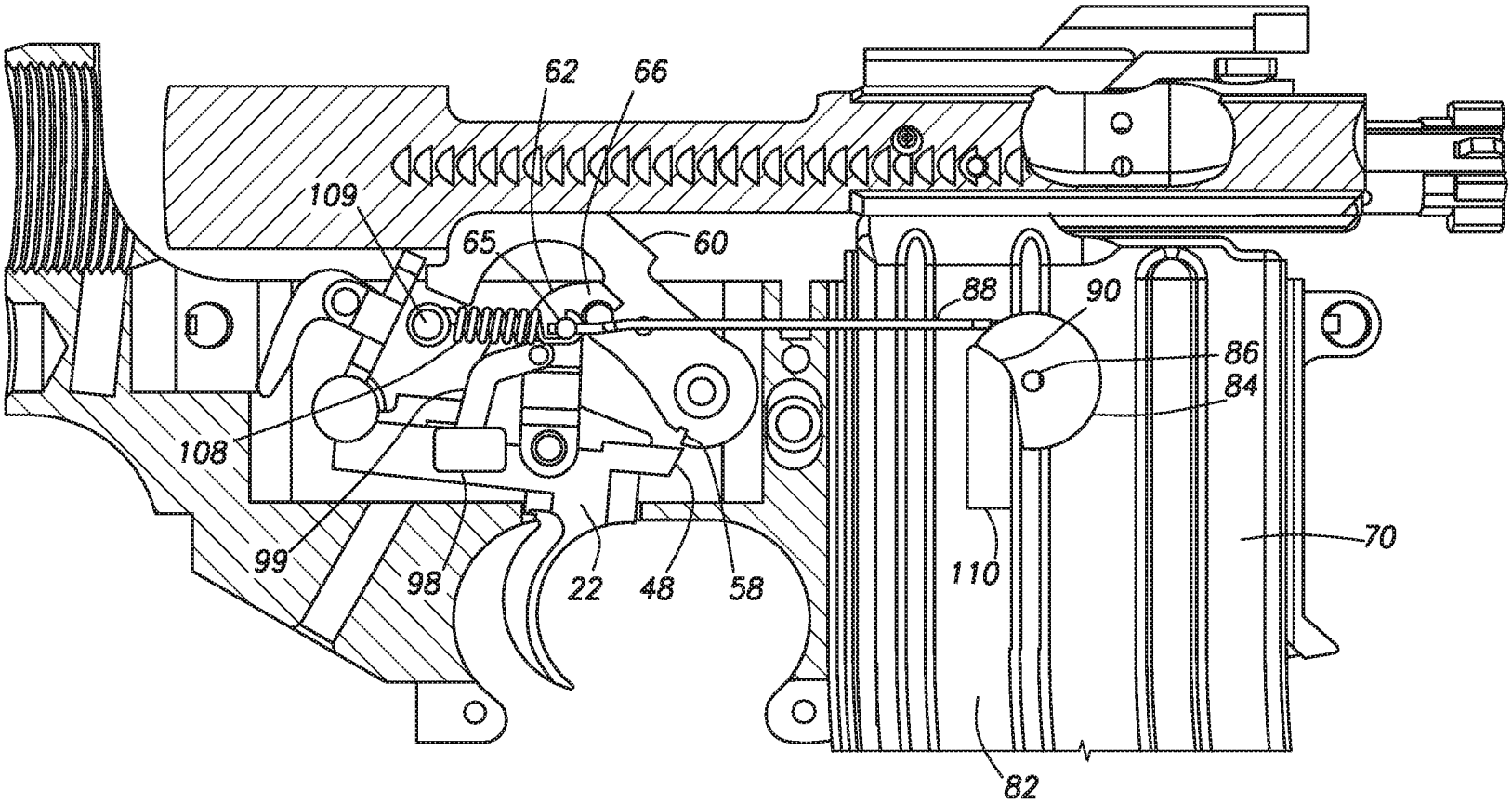
FIG. 4 is a side elevational, sectional and partial view of the exemplary auto-loading firearm of FIG. 3 in training mode, with the trigger depressed and the hammer remaining in a cocked position.

FIG. 3 is a side elevational, sectional and partial view of an exemplary auto-loading firearm in training mode, with the trigger in a home (not depressed) position and the hammer in a cocked and interrupted position. FIG. 4 is a side elevational, sectional and partial view of the exemplary auto-loading firearm of FIG. 3 in training mode, with the trigger depressed and the hammer remaining in a cocked position. The FIGS. 3-4 are discussed together.

A training mode assembly includes a selector switch assembly 80, an action arm assembly for interrupting operation of the hammer 60, and a trigger break simulator 92.

The action arm assembly has an action arm 62 mounted in the firearm frame 12 for movement between a live fire position, in which the action arm 62 does not interfere with operation of the hammer 60, seen in FIGS. 1-2, and a training mode position, seen in FIGS. 3-4, wherein the action arm 62 interrupts operation of the hammer 60. The action arm 62, in the training mode position, engages the hammer and interrupts normal operation of the hammer 60.

The exemplary action arm 62 seen here is mounted for rotational movement about an action arm pivot 64. In alternate designs, the action arm 62 can move between the live fire and training mode positions by sliding, rotating, or otherwise. Here, the action arm 62 uses as its pivot 64 the trigger pivot 24. Alternately, the action arm can rotate about a separate pivot.

The action arm 62 defines an engagement mechanism 66 for selective engagement with a cooperating engagement mechanism 68 on the hammer 60. In the embodiment shown, the action arm engagement mechanism 66 is a simple hook defined on the distal end of the action arm 62 and the cooperating mechanism 68 on the hammer 60 is a simple post. In the live fire position, the engagement mechanism of the action arm does not engage the cooperating mechanism on the hammer, as seen in FIGS. 1-2. In the training mode position, the engagement mechanism 66 (e.g., hook) engages the cooperating mechanism 68 (e.g., post) defined on the hammer 60 and consequently maintains the hammer 60 in a cocked (or near-cocked) position and prevents release of the hammer 60 to the discharge position.

More specifically, in many firearms the hammer 60 is rotated, upon manual cocking and/or automatic re-cocking, through and past the cocked (and ready to discharge) position seen in FIG. 1. For example, such an "over-rotation" can be used to place the hammer 60 in position to be temporarily engaged by a disconnector as described above and as known in the art. Similarly, in the training mode position, the hammer 60 can be rotated past the cocked position of FIG. 1 such that the trigger sear 48 does not engage and is spaced apart from the notch 58 defined on the hammer 60. The hammer engagement mechanism 66 maintains the hammer 60 in this slightly over-rotated position in the embodiment shown. In such an embodiment, the sear 48 does not act on or contact the hammer 60.

In alternative arrangements, the action arm and hammer engagement mechanisms can comprise or include one or more latches, spring latches, cam locks, or other releasably engageable mechanisms.

A trigger break simulator 92 is mounted within the firearm, preferably to frame 12. The simulator 92 is moved between a home or live fire position, seen in FIGS. 1-2, and a training mode position, seen in FIGS. 3-4. In the shown embodiment, the trigger break simulator 92 includes an activation mechanism 99, here a dog-legged arm, operable by the transfer mechanism 84. Here, the dog-legged arm is pivotally attached at one end to a simulator casing 98 or components therein and pivotally attached at the other end to the action arm 62. Alternately, the dog-legged arm can be attached directly to the linkage 88, for example. The simulator acts on or is acted upon by the trigger 22 and is preferably located within the firearm adjacent the trigger. Alternate locations are possible but may then require linkages to the trigger.

In the live fire position, the simulator does not operate. In the training mode position the simulator provides the user with a simulation of the "trigger break" phenomenon. That is, the feel of pulling the trigger under normal operating tension until that tension breaks or sharply decreases as the sear disengages from and releases the hammer. Operation of the simulator is discussed further below.

In FIG. 3, the trigger 22 is in the home position while the firearm is in the training mode. In this embodiment, the home position of the trigger 22 in training mode is identical to the home position of the trigger 22 in live fire mode.

Selective movement of the action arm 62 and activation of the trigger break simulator between live fire and training mode positions is in response to operation of the selector switch assembly. The firearm is in live fire mode (FIGS. 1-2) and remains so unless the selector switch assembly 80 is forcibly moved into training mode (FIGS. 3-4).

In the exemplary embodiment, the selector switch is forced into training mode position when a specialized training device is selectively attached to the firearm and returns to live fire mode when such specialized training attachment is removed from the firearm. In the embodiment shown, the training device 70 is a training magazine. The exemplary training magazine operates to switch the firearm from live fire to training mode upon insertion of the training magazine into the magazine well 14 of the firearm. The training device and the selector switch assembly can both take various designs according to aspects of the disclosure.

Turning to FIGS. 3-4, a selector assembly 80 includes a transfer mechanism 84 movable between a live and training position. In the shown embodiment, the transfer mechanism 84 is a rotary cam rotatably mounted on a transfer pivot 86 supported by the frame 12. The transfer mechanism 84 rotates within a transfer lever cavity defined in the firearm frame or magazine well. The transfer mechanism 84 is in a home or live fire position in FIGS. 1-2. The transfer mechanism 84 defines a cam surface 90 aligned with and extending into a push bar channel 82 defined in the magazine well 14.

A linkage assembly 88, here a wire or rod, is attached at one end to the rotary cam transfer mechanism 84 and at the other end to the action arm 62 such as at a post 65, aperture, slot or other mechanism for that purpose. Rotary movement of the transfer mechanism 84 results in generally linear movement of the linkage 88 which in turn causes rotational movement of the action arm 62. Other linkage assemblies can be employed including hinged or moveably connected linkage parts and movement of the linkage can be linear, rotary, or otherwise.

A selector switch biasing assembly 104 preferably operates to bias the selector switch assembly towards its live fire position. The live fire position is thus the default position for the selector switch assembly. A biasing mechanism 108 biases the action arm 62, and the transfer mechanism 84 towards and into their home or live fire positions. Here the biasing mechanism 108 is a coil spring connected between the firearm frame 12 at retainer 109 and to the action arm 62. Other biasing mechanisms such as torque springs, leaf springs, etc., as are known in the art can be used. As the transfer mechanism 84 is rotated to the training position seen in FIGS. 3-4, the linkage 88 rotates the action arm 62 against the biasing mechanism 78.

Insertion and removal of a live magazine into the magazine cavity does not activate or otherwise operate the selector switch assembly or transfer mechanism 84. The live fire and training magazines interact with a cooperating magazine catch and release assembly in any manner known in the art.

In FIG. 3, training magazine 70 push bar 110 is seen in position after insertion into the magazine well 14 and engagement of the transfer mechanism 84. Manual positioning of a training magazine 70 into the magazine well causes the push bar 110, integral to or mounted on the training magazine, to slide upward in the magazine well 14, preferably along the push bar channel 82 designed for that purpose. At or near the upper end of the push bar channel 82, the push bar 110 activates the transfer mechanism 84 by engaging the cam surface 90 and causing rotation of the transfer mechanism. Linear movement of the push bar 110 upward while in contact with the cam surface 90 causes rotation of the transfer mechanism 84, movement of the linkage 88, rotation of the action arm 62, and rotation of the simulator activation mechanism 99.

Upon removal of the training magazine, the push bar 110 moves downward and out of engagement with the transfer mechanism 84. The biasing mechanism 108 acts to rotate the action arm 62, transfer mechanism 84, and simulator activation mechanism 99 to their home or live fire positions. That is, the selector switch biasing assembly moves the selector switch assembly from the training to the live fire position when the training device is removed and thus no longer maintains the selector switch assembly in the training position.

In FIG. 4, the firearm is in the training mode with the trigger 22 depressed by the user. Operation of the trigger 22 is unaffected in training mode. The trigger depressed position in training mode (FIG. 4) is the same as the trigger depressed position in the live fire mode (FIG. 2). The trigger return spring, if present, continues to bias and return the trigger to the home position after firing and upon release of the trigger. As the trigger 22 is depressed in training mode, the trigger 22 moves relative to the adjacent simulator casing 98. Mechanisms in the simulator operate on the trigger 22 to cause a simulated trigger break. Movement of the trigger 22 while the firearm is in the training mode does not cause noticeable movement of the action arm 62, simulator casing 98, simulator activation mechanism 99, or hammer 60. In the training mode, the sear 48 is disengaged at all times from the hammer 60.

Traditional safeties can also be used as with known auto-loading firearms, including those which are slide, frame, trigger or grip mounted, lever, pivot, or push activated, and which can act upon the trigger, sear, disconnect, hammer, firing pin, or within the magazine. Operation of traditional safeties is preferably not effected by switching between live and training modes. That is, one or more traditional safeties are operable by the user when the firearm is in training mode, providing a realistic training experience.

Figure 5A:
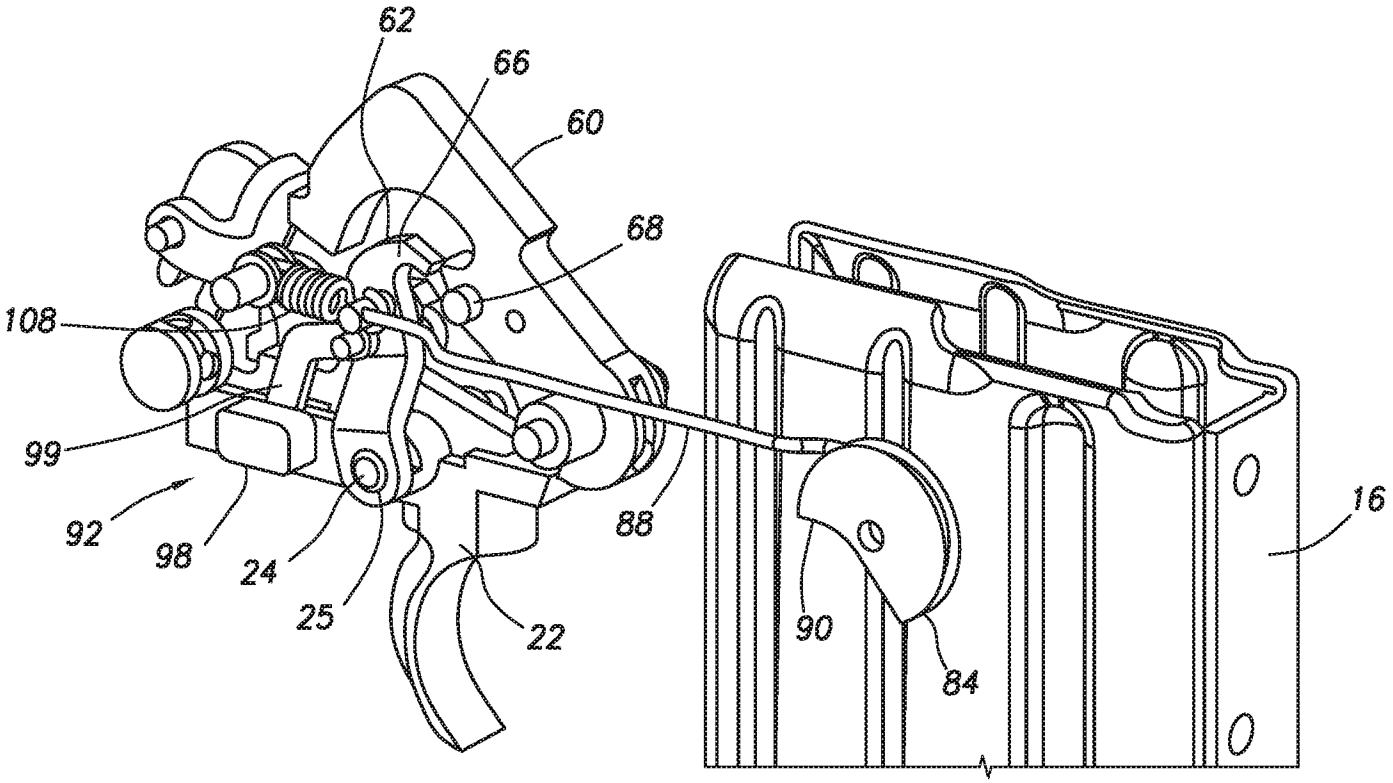
FIG. 5A is a detail orthogonal view of selected elements of the firearm in a live fire mode according to an embodiment of the disclosure.
Figure 5B:
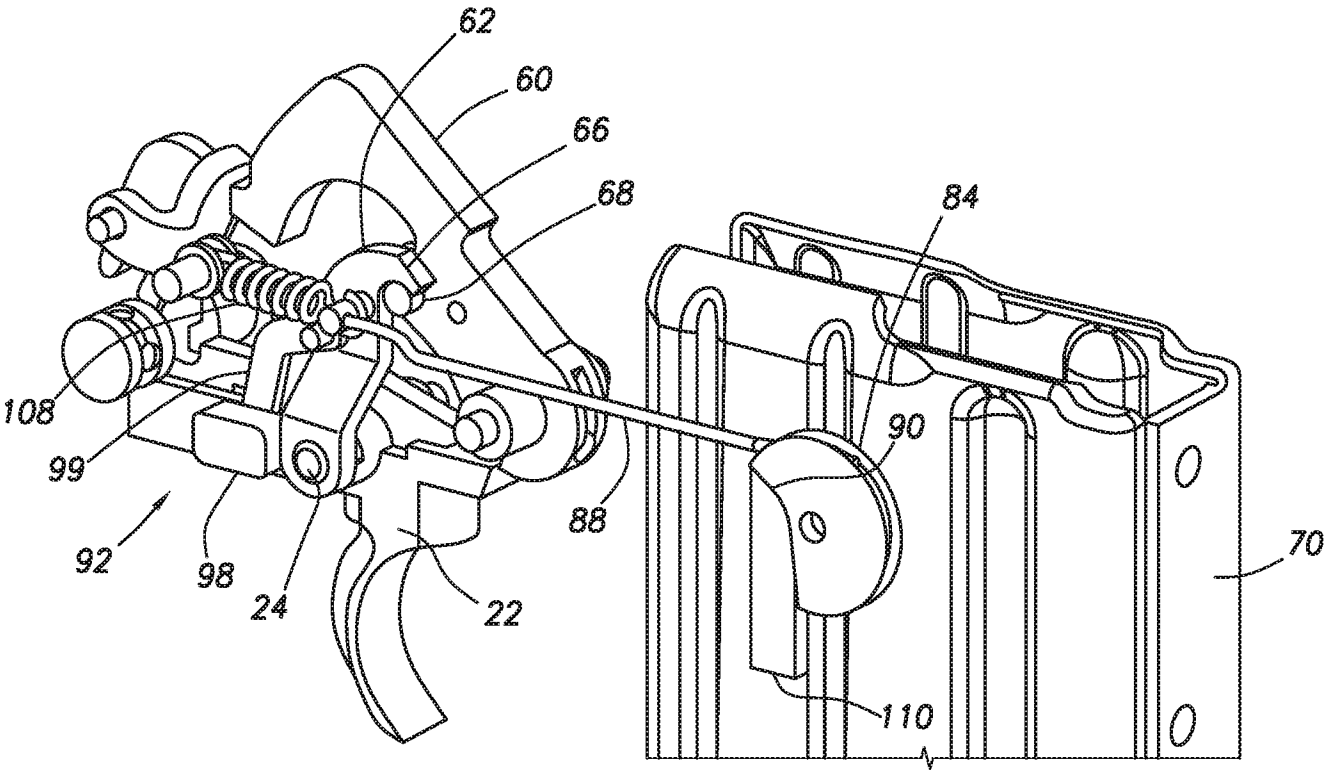
FIG. 5B is a detail orthogonal view, as in FIG. 5A, of selected elements of the firearm in a training mode according to aspects of the disclosure.

FIG. 5A is a detail orthogonal view of selected elements of the firearm in a live fire mode according to an embodiment of the disclosure. FIG. 5B is a detail orthogonal view, as in FIG. 5A, of selected elements of the firearm in a training mode according to aspects of the disclosure.

FIG. 5A shows the firearm in the live mode with an ammunition magazine 16 positioned as if in the magazine well 14 of the firearm. (The well is not seen so as to make the magazine visible. Similarly, the transfer mechanism 84 appears to "float" as the magazine well wall to which it is attached is not shown as it would obscure the mechanism.) The magazine 16 does not interact with the selector switch assembly 80 and does not rotate or move the transfer mechanism 84 assembly. Thus the transfer mechanism 84, the linkage 88, the action arm 62, and the simulator activation mechanism 99 all remain in the home or live fire position. The engagement mechanism 66 (e.g., hook) of the action arm 62 does not engage the cooperating mechanism 68 (e.g., post) defined on the hammer 60 and the hammer 60 is free to rotate from the cocked position to the discharge position when the trigger 22 is depressed.

FIG. 5B shows the firearm in the training mode with a training device 70, specifically a training magazine, positioned as if in the magazine well 14 of the firearm. The training magazine 70 defines a push bar 110 which, when the training magazine was inserted into the magazine well 14, contacted and pushed the cam surface 90 of the transfer mechanism 84, thereby rotating the transfer mechanism to the training position. Thus the transfer mechanism 84, the linkage 88, the action arm 62, and the simulator activation mechanism 99 all are in the training mode position. The engagement mechanism 66 (e.g., hook) of the action arm 62 engages the cooperating mechanism 68 (e.g., post) defined on the hammer 60 and the hammer 60 is not free to rotate from a cocked position to the discharge position when the trigger 22 is depressed.

Figure 6A:
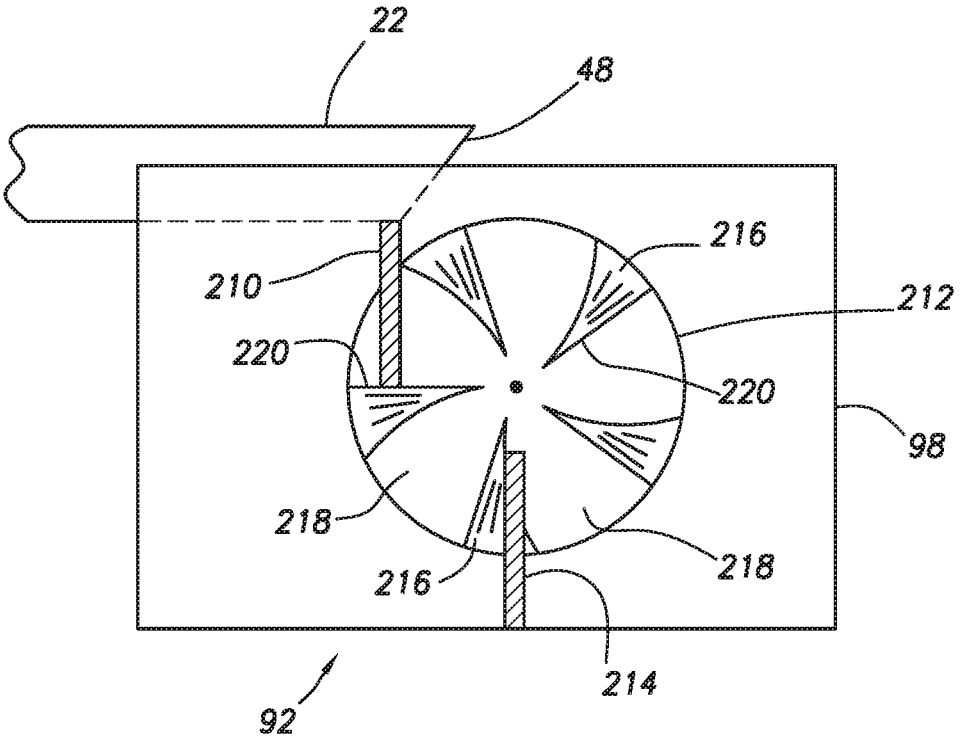
FIG. 6A is a schematic of an exemplary trigger break simulator 92 according to an aspect of the disclosure.

FIG. 6A is a schematic of an exemplary trigger break simulator 92 according to an aspect of the disclosure. An exemplary trigger break simulator 92 includes a push rod 210 which, when the simulator is in the training position, fixedly engages the trigger 22 and selectively engages a rotary disk 212 which is rotatably attached to the simulator casing 98. A tension bar 214 is attached to the simulator casing 98 with a free end which interferes with free rotation of the disk 212. As the trigger is depressed, the push rod 210 moves with, and due to movement of, the trigger 22, contacts a vertical surface 220 defined on the disk face, and forces the rotary disk 212 to rotate (here, counter-clockwise). The disk 212 defines on its face alternating sloped surfaces 216 and low profile channels 218 separated by vertical surfaces 220. As the disk 212 rotates, the tension bar 214 contacts and bends the tension bar 214 with increasing force until the tension bar clears the sloped surface 216 at a vertical surface 220 and springs back to its unbent shape in one of the channels 218 of the disk. Release of the tension bar simulates the trigger break sensation felt by the user. As the trigger 22 returns to its home position, under influence of the trigger return spring, the push rod 210 moves (vertically in FIG. 6A) to a position to engage the next vertical surface defined on the disk. The tension bar 214, if necessary, acts on the next rotary disk sloped surface to prevent back-spinning of the disk.

In an alternate embodiment, the "push" rod can instead be a "pull" rod, applying force to the disk in the opposite direction. Further, the term "rod" as used here does not limit the shape of the member acting on the disk. The push or pull rod is moved into a training position, wherein it engages the trigger 22, and into a live fire position, wherein the rod does not engage the trigger, by movement of the simulator assembly or selector switch assembly into the training position.

Figure 6B:
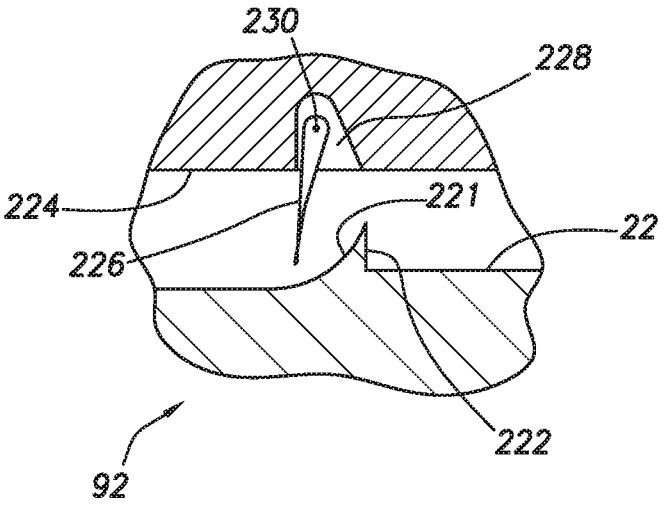
FIG. 6B is a schematic of another exemplary trigger break simulator according to an aspect of the disclosure.

FIG. 6B is a schematic of another exemplary trigger break simulator according to an aspect of the disclosure. The trigger 22 defines a sloped surface 221 and vertical face 222 for interacting with the simulator. The simulator 92 includes a movable body 224 to which is attached a hinged tension bar 226. The tension bar 226 is free to pivot in a first direction, the movable body having a channel 228 or similar allowing the tension bar to pivot freely. In the opposite direction, the tension bar is prevented from pivoting on its hinge 230 by a portion of the movable body 224 and instead must bend when placed under sufficient force. As the trigger 22 moves (to the left in the figure) as it is depressed by the user, the tension bar contacts the sloped surface 221 and increasingly bends under force of the moving trigger 22, providing increasing resistance to movement of the trigger 22. The trigger continues its leftward movement until the sloped surface 221 clears contact with the tension bar 226 at vertical face 222. This release of resistance provides the "trigger break" sensation to the user. Upon release of the trigger 22, it returns to its home position under influence of the trigger spring. The return motion of the trigger 22 is not retarded by the tension bar 226 as the vertical face of the trigger simply pivots the tension bar 226 freely about its hinge 230. Once the trigger is clear of the tension bar 226, it returns to its home position. In the live fire position, the simulator does not contact the trigger surfaces as the movable body 224 is spaced apart from the trigger. The simulator movable body 224 is moved into an engagement position with the trigger by operation of the selector switch assembly and consequent movement of the dog-legged arm 62, for example.

Alternative methods include a simple resistance spring for returning the trigger to its home position (with or without trigger break simulation included), a compression spring with reset (a "frog clicker" model), and an electronic implementation based on electromagnets.

Figure 7:
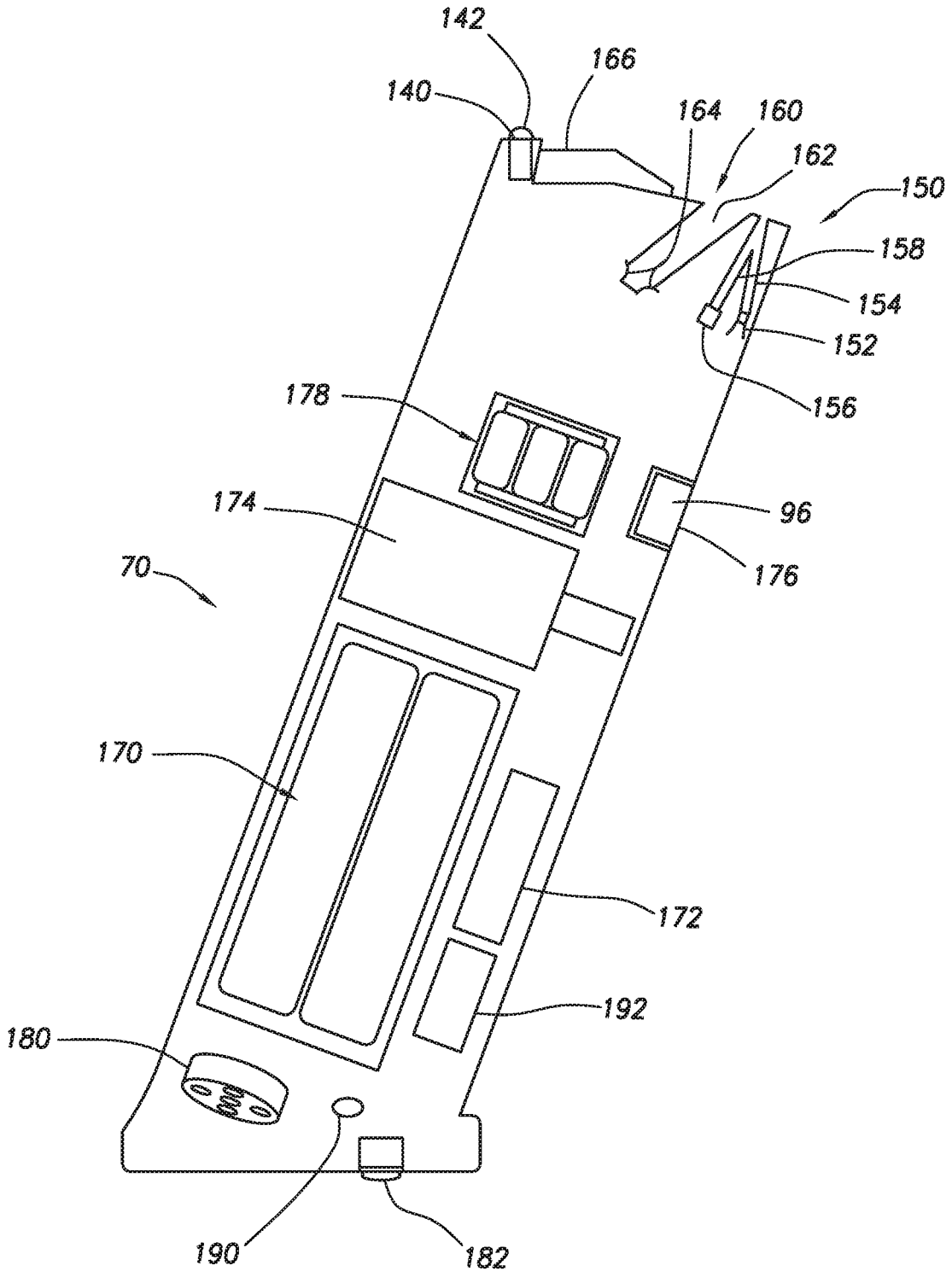
FIG. 7 is a sectional elevation view of an exemplary training device including internal components according to aspects of the disclosure.
Figure 8:
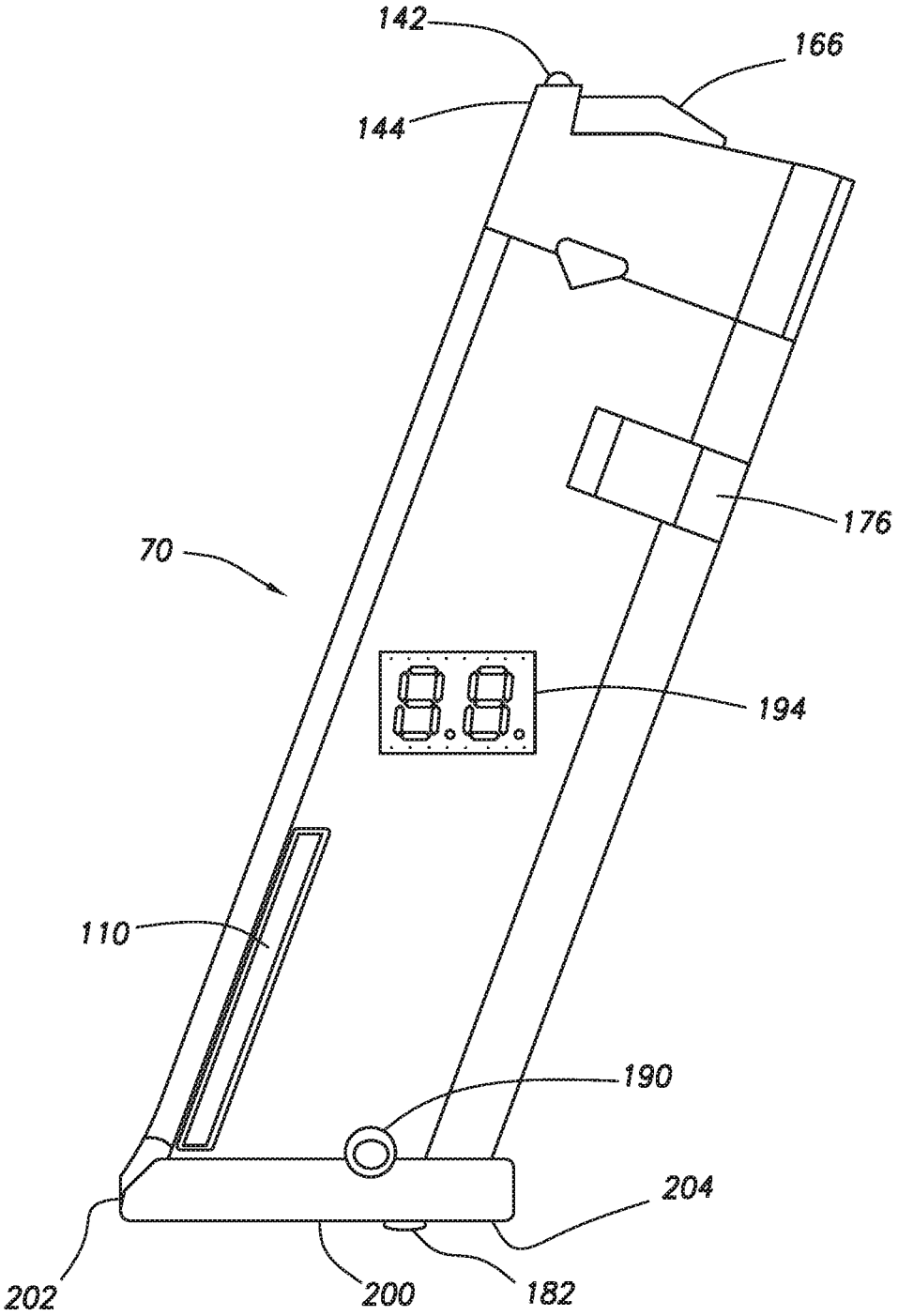
FIG. 8 is an elevational view of an exemplary training device according to aspects of the disclosure.

FIG. 7 is a sectional elevation view of an exemplary training device including internal components according to aspects of the disclosure. FIG. 8 is an elevational view of an exemplary training device according to aspects of the disclosure. FIGS. 7 and 8 are discussed together.

FIG. 7 illustrates some internal and body components of an exemplary training magazine 70. To register proper movement of the auto-loading firearm's slide or bolt while in training mode, a slide movement switch 140 having a switch dome 142 or the like is positioned to be depressed and released by movement of the slide or bolt. A live round block 144 is preferably provided at the upper end of the training magazine 70. The round block 144 prevents manual insertion of a live round into the training magazine. Further, any attempt to rack a round in the chamber, which may allow the training mode to operate, would also eject the round. Thus the live round block acts as an additional safety mechanism to prevent accidental discharge of the weapon. The round block can also provide a housing for the slide movement switch components.

A round sensor assembly 150 is provided in some embodiments. The round sensor assembly 150 includes a round sensor light emitter 152 positioned at the base of a light channel 154 defined in the magazine. Similarly, an optical sensor 156 is positioned at the base of an optical channel 158 defined in the magazine. The light emitter 152 emits light sufficient to reflect off of a round loaded in the barrel of the firearm, whereupon the optical sensor 156 detects the reflected light and transmits a signal to the microcontroller 172 that a round is loaded. In the exemplary case, the microcontroller 172 then prevents the standard lighting of LED lights 190 to indicate that the firearm is not fully safe for training. When a live round is absent or ejected, the optical sensor 156 will not signal the presence of a loaded round to the microcontroller 172. The design of the round sensor assembly can vary in terms of placement and orientation, depending on the physical configuration of the firearm, and can have more or fewer components and channels depending on design choice.

A training laser interface 160 is also illustrated having a lead channel 162, and positive and negative leads 164. Laser retaining structures, such as lips or rails 166, can be provided. The laser is both powered and activated by the training attachment through the microcontroller and the momentary switch 140. The power supply 170 is positioned in the training magazine (or other training attachment in other embodiments). In an embodiment, the laser is activated by a momentary switch 140 such that the laser provides a momentary laser burst at or near the time of pulling the trigger in training mode. Hence, the laser assembly indicates the occurrence of training fire, denotes the location where a round would strike, and can work with commercially available laser-detecting targets.

Various electrical components can be mounted in the training magazine such as a power supply 170, a microcontroller 172, circuit wiring (not shown), a magazine release lead or sensor 176, a capacitor bank 178, an RFID or other tag, and other electronic components which will be obvious to those of skill in the art. Each of the electrical assemblies is operably connected to a power supply and the microcontroller. The microcontroller controls functionality of the various sensors and electrical components which can communicate sensed conditions to the microcontroller. For example, the microcontroller can be used to signal error conditions, provide a count of rounds fired, activate other feedback mechanisms such as the recoil solenoid and the speaker, control said mechanisms to provide specific amounts of recoil, noise, or rounds, simulate firearm malfunctions, interface with external training components including scoring devices and position detectors, and maintain training records among other uses.

A speaker 180 can be provided for emitting training sounds such as a simulated firearm report. Buttons or other controls 182 can be mounted such that they are accessible from the exterior of the training magazine while the magazine is inserted into the firearm. A recoil solenoid 174 can be provided for simulating firearm recoil. Recoil and sound mechanisms can be keyed to the "round counting" of the microcontroller such that the microcontroller produces sound and recoil when the training magazine is "loaded," but does not provide such feedback after the training magazine is "emptied." A "re-set" button or the like can extend from the training magazine to allow the user to re-load and re-use the magazine.

LED lights or other active indicators 190 can be positioned on the magazine 70 and elsewhere on the firearm. The indicators can communicate that the firearm is in training mode. The indicators can be used to indicate battery charge level and option configuration status. Active indicators can be infrared indicators, invisible to the naked eye but visible through an infrared viewing device. This may be useful in group training and tactics exercises. The indicators can provide information to the user by colored lights, color-changing lights, flash or blink patterns, etc.

An informational display 194 can be provided for displaying data to the user. Such data can include number of simulated rounds available, battery charge status, error codes, and user option selections. In an embodiment, the display is visible when the training magazine is removed from the firearm. The display (as well as the other electronic components discussed herein) can be positioned anywhere on the training magazine.

The system can also be used in logistics training. For example, the training magazine (or other training attachment) can be programmed, via the microcontroller, to allow a user to "re-load" the magazine a set number of times equaling the number of magazines the user would have in a live fire situation. Further, the microcontrollers of multiple firearms can be programmed such that, in tow, they allow multiple users a selected number of rounds or re-loads by the users, thereby allowing "sharing" of ammunition among users with a maximum amount of ammunition available to the group. Also, an on-site, electronic, virtual ammunition depot can be used in conjunction with the training firearms such that, upon exhausting his selected number of training rounds or magazines, the user is required to physically go to the ammunition depo to re-arm themselves with another set of training rounds or magazines. For example, when out of training rounds, as indicated by the firearm in training mode (by indicators, feedback mechanisms, etc.), a user re-arms by taking the training magazine (or attachment) to the ammunition depo. An electronic interaction between the user's magazine and the depot effectively "re-loads" the training magazine with a selected number of training rounds and/or magazines.

Multiple virtual depots can be used in conjunction, connected or networked to one another and/or a central computer for communication and coordination, such that multiple smaller groups of users have access to a central ammunition depot with a selected amount of ammunition. The virtual depots (or networked computer) can track and control: ammunition use per user, ammunition use per group of users (e.g., a team, a platoon), per firearm, per type of firearm or ammunition (e.g., both semiautomatic handguns and automatic rifles), etc. The depot can limit the total amount of ammunition available (for one or multiple types of firearm) for distribution to the group, such that the group is trained in logistical use of limited available ammunition. For prolonged training exercises, the virtual depot can also mimic restocking and resupply.

The training magazine can include a base plate 200, base plate hinge 202, and base plate release 204 to allow access to the magazine internal components. A magazine release mechanism 96 is discussed above herein. Similarly, the push bar 110 is described above herein. Various cavities, channels, mountings, and alignment and positioning features can be defined in and on the magazine, internally and externally, to allow for placement of sensors, electronics, lights and indicators, and other components.

Further, the training magazine can include a communications device 192, such as a Bluetooth device, infrared (IR) device, wireless device, Ethernet device, etc. The communications device communicates with the microcontroller or computer 172. The communications device is preferably operable to receive and send data to other devices having corresponding communications abilities.

Further, the firearm itself can include onboard storage which has multiple functions and can consist of some form of static storage (e.g., Write Once, Read Many) and a dynamic component (e.g., read and write). The static storage can be used for manufacturer data and serialization features, and the dynamic storage can be for data and state information storage to allow advanced training functionality. Additionally, it allows encoding of data into a laser targeting component (assuming such a capability on the model of firearm) for training. This can be accessed through wired or wireless connection. Onboard storage can be powered by a power source onboard the firearm or by the power source in the training mode device such as the training magazine.

The following disclosure is provided in support of the methods claimed or which may be later claimed. Specifically, this support is provided to meet the technical, procedural, or substantive requirements of certain examining offices. It is expressly understood that the portions or actions of the methods can be performed in any order, unless specified or otherwise necessary, that each portion of the method can be repeated, performed in orders other than those presented, that additional actions can be performed between the enumerated actions, and that, unless stated otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed, both herein below and throughout, can be performed in any order (xyz, xzy, yxz, yzx, etc.) without the wasteful and tedious inclusion of writing out every such order.

Further, disclosed herein are methods comprising steps as indicated. 16. A method of switching an auto-loading firearm between a live fire mode in which the firearm is operable to discharge rounds of ammunition and a training mode wherein the firearm is prevented from firing rounds of ammunition, the method comprising: moving a selector switch from a live fire position to a training mode position; in response to moving the selector switch to the training mode position, moving an action arm into engagement with a hammer of the firearm, the action arm preventing the hammer from moving to discharge the firearm; and with the selector switch in the training mode position, resetting the trigger from a depressed position to a home position. 17. The method of claim 16, further comprising: returning the selector switch to the live fire position from the training mode position; in response to returning the selector switch to the live fire position, moving the action arm out of engagement with the hammer. 18. The method of claim 17, further comprising, after returning the selector switch to the live fire position: depressing the trigger and thereby moving a sear; in response to moving the sear, releasing the hammer to move under a hammer biasing force; and discharging the firearm. 19. The method of claim 16, further comprising, in response to moving the selector switch to the training mode position: moving a trigger break simulator into a training mode position; depressing the trigger; and in response to depressing the trigger, resetting the trigger to a home position. 20. The method of claim 16, wherein engaging the action arm with the hammer further comprises: moving the action arm with respect to the hammer, the action arm defining a hook, the hammer defining a post, the hook of the action arm contacting the post of the hammer. 21. The method of claim 16, further comprising: attaching a selectively detachable device to the firearm and moving the selector switch in response thereto. 22. The method of claim 16 further comprising: biasing the selector switch toward the live fire position. 23. The method of claim 21, wherein the selector switch is movably mounted either on the firearm or on the detachable device. 24. The method of claim 19, activating a recoil mechanism or emitting a sound in response to depression of the trigger. 25. The method of claim 16, further comprising, with the selector switch in the training mode position: automatically tracking virtual rounds available or expended, and simulating a firearm malfunction and preventing expending of further virtual rounds until the simulated malfunction is corrected.

For further disclosure on the operation and parts of exemplary hammer-type and striker-type self-loading firearms, see the following references which are each incorporated herein by reference for all purposes including support of the claims: GLOCK Semiautomatic "SAFE ACTION" Pistols, Glock 17, 19, 20, 21, 22, 23 & 17L, Glock Armorer's Manual, Glock, Inc. (January 1992), 60 pages; Springfield Armory, XD Operation and Safety Manual, Springfield, Inc.

(2008), 45 pages; HK USP Pistol Armorers Instruction, Heckler Koch, 39 pages; SIGARMS Training, P220 Combat Pistol, Armorers Manual, SIGARMS, 61 pages; SIG SAUER, P320, Owner's Manual: Handling & Safety Instructions, Sig Sauer, Inc., 68 pages; U.S. Pat. No. 8,156,677 B2 to Glock, issued Apr. 17, 2012, entitled "Assemblies and Firearms Incorporating Such Assemblies;" U.S. Pat. No. 5,655,326, to Levavi, et al., issued Aug. 12, 1997, entitled "Method of Deploying a Weapon Utilizing the "Glock System" which Provides Maximum Safety and Readiness."

Use of the term "training" throughout is not intended as a limitation in purpose or use of the apparatus or method. Certainly the disclosure also addresses other purposes and uses, such as operational safety, educational use of firearms, etc. The term "training" is used as a short-hand term and encompasses any purposes applicable to provision and use of an auto-loading firearm having a live fire mode in which ammunition can be discharged and a "non-live fire" mode in which discharge of live ammunition is prevented but wherein some or all aspects of the self-loading mechanism still operate such that the user does not have to manually reset (e.g., pull the slide, push the trigger forward, etc.) after "firing" the firearm in the non-live fire mode.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The words "comprising," "containing," "including," "having," and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed.

As used herein, the words "consisting essentially of," and all grammatical variations thereof are intended to limit the scope of a claim to the specified materials or steps and those that do not materially affect the basic and novel characteristic(s) of the claimed disclosure.

The indefinite articles "a" or "an" mean one or more than one of the component, part, or step that the article introduces. The terms "and," "or," and "and/or" shall be read in the least restrictive sense possible. Each numerical value should be read once as modified by the term "about" (unless already expressly so modified), and then read again as not so modified, unless otherwise indicated in context.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The disclosure should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. An auto-loading firearm having a system for switching the firearm between a live fire mode and a training mode, the firearm comprising:

a trigger movable between a home position and a depressed position;

a hammer movable between a cocked position and a discharge position, the hammer biased towards the discharge position, the hammer operable to discharge the firearm upon movement from the cocked to the discharge position;

a sear operable to maintain the hammer from moving to the discharge position until sufficient force is placed on the trigger;

wherein, in a live fire mode:

with the hammer in the cocked position and the trigger in the home position, the trigger and sear act to maintain the hammer in the cocked position against the bias on the hammer; and in response to movement of the trigger to the depressed position, the trigger moves the sear and releases the hammer to move from the cocked to the discharge position;

an arm movable between a live fire position wherein the arm does not interrupt movement of the hammer between the cocked and discharge positions, and a training mode position wherein the arm prevents movement of the hammer to the discharge position;

a selector switch selectively movable between a live fire position and a training mode position, wherein the arm moves to the training mode position in response to movement of the selector switch to the training mode position, and wherein the arm moves to the live fire position in response to movement of the selector switch to the live fire position;

a trigger break simulator mounted on the firearm adjacent the trigger and moveable, in response to movement of the selector switch, between a live fire position and a training mode position, the trigger break simulator not interfering with operation of the trigger when in the live fire position, the trigger break simulator operable to simulate trigger break when in the training mode position; and a trigger return spring, operable to return the trigger to the home position in response to movement of the trigger to the depressed position.

2. The auto-loading firearm of claim 1, wherein the selector switch moves the arm to its training mode position in response to attachment of a training device to the firearm.

3. The auto-loading firearm of claim 2, wherein the selector switch is movably attached to the training device or to a frame of the firearm.

4. The auto-loading firearm of claim 1, further comprising a biasing assembly, the biasing assembly biasing the selector switch toward the live fire position.

5. The auto-loading firearm of claim 4, wherein the selector switch moves to the training mode position in response to attachment of a training device to the firearm, and wherein the biasing assembly automatically moves the selector switch from the training mode position to the live fire position upon detachment of the training device.

6. The auto-loading firearm of claim 1, further comprising a biasing assembly operable to bias the arm toward the live fire position.

7. An auto-loading firearm including a system for switching the firearm between a live fire mode and a training mode, the firearm comprising:

a trigger movable between a home position and a depressed position;

a sear mechanism for releasing a hammer to discharge the firearm;

an action arm selectively movable to prevent the hammer from moving to discharge the firearm;

a trigger break simulator moveable between a live fire position in which the trigger break simulator does not interfere with operation of the trigger to discharge the firearm, and a training position wherein the trigger break simulator is operable to simulate trigger break when the trigger is moved from the home position to the depressed position; and a selector switch for moving the action arm to prevent the hammer from moving to discharge the firearm, and for moving the trigger break simulator to the training position.

8. The auto-loading firearm of claim 7, wherein the selector switch moves the action arm to its training mode position in response to attachment of a training device to the firearm.

9. The auto-loading firearm of claim 8, wherein the training device comprises a training magazine insertable into a magazine well of the firearm.

10. The auto-loading firearm of claim 9, wherein the selector switch moves to the training mode position in response to attachment of a training device to the firearm, and wherein a biasing assembly automatically moves the selector switch from the training mode position to the live fire position upon detachment of the training device.

11. The auto-loading firearm of claim 8, wherein the selector switch is movably attached to the training device or to a frame of the firearm.

12. The auto-loading firearm of claim 7, further comprising a biasing assembly, the biasing assembly biasing the selector switch toward the live fire position.

13. The auto-loading firearm of claim 7, further comprising a biasing assembly operable to bias the action arm toward the live fire position.

14. The auto-loading firearm of claim 7, wherein, in the live fire mode, pulling of the trigger requires a normal operating tension to cause the sear mechanism to release the hammer to discharge the firearm, the normal operating tension required to move the trigger sharply decreasing at the point where the sear releases the hammer; and wherein, in the training mode, pulling of the trigger break simulator requires a simulation operating tension to operate the trigger, the simulation operating tension the same as the normal operating tension, and the simulation operating tension required to move the trigger sharply decreasing at the same point.

15. The auto-loading firearm of claim 7, wherein the trigger break simulator comprises: a movable body movable into engagement with the trigger by operation of the selector switch.

16. The auto-loading firearm of claim 7, wherein movement of the selector switch is connected to the action arm, and the action arm is connected to the trigger break simulator.

17. The auto-loading firearm of claim 7, wherein, in the training mode, the sear mechanism is spaced apart from the hammer.

18. A method of switching an auto-loading firearm between a live fire mode in which the firearm is operable to discharge rounds of ammunition and a training mode wherein the firearm is prevented from firing rounds of ammunition, the method comprising:

moving a selector switch from a live fire position to a training mode position;

in response to moving the selector switch to the training mode position, moving an action arm into engagement with a hammer of the firearm, the action arm preventing the hammer from moving to discharge the firearm; and in response to moving the selector switch to the training mode position, moving a trigger break simulator into engagement with the trigger.

19. The method of claim 18, further comprising:

returning the selector switch to the live fire position from the training mode position;

in response to returning the selector switch to the live fire position, moving the action arm out of engagement with the hammer and moving the trigger break simulator out of engagement with the trigger.

20. The method of claim 19, further comprising, after returning the selector switch to the live fire position:

depressing the trigger and thereby moving a sear;

in response to moving the sear, releasing the hammer to move under a hammer biasing force; and discharging the firearm.

21. The method of claim 18, further comprising, with the selector switch in the training mode position:

depressing the trigger; and in response to depressing the trigger, returning the trigger to a home position using a trigger return spring.

22. The method of claim 18, wherein moving the action arm into engagement with the hammer further comprises: moving the action arm with respect to the hammer, the action arm defining an engagement mechanism, the hammer defining a cooperating engagement mechanism, the engagement mechanism of the action arm contacting the cooperating engagement mechanism of the hammer.

23. The method of claim 18, further comprising: attaching a selectively detachable training device to the firearm and, in response thereto, moving the selector switch to the training mode position.

24. The method of claim 18, further comprising, with the selector switch in the training mode position: automatically tracking virtual rounds available or expended, and simulating a firearm malfunction and preventing expending of further virtual rounds until the simulated malfunction is corrected.

* * * * *